US006535847B1

(12) United States Patent
Marston

(10) Patent No.: US 6,535,847 B1
(45) Date of Patent: Mar. 18, 2003

(54) AUDIO SIGNAL PROCESSING

(75) Inventor: David F. Marston, Bembridge (GB)

(73) Assignee: British Telecommunications public limited company, London (GB)

( * ) Notice: Subject to any disclaimer, the term of this patent is extended or adjusted under 35 U.S.C. 154(b) by 0 days.

(21) Appl. No.: 09/395,933

(22) Filed: Sep. 14, 1999

(30) Foreign Application Priority Data

Sep. 17, 1998 (EP) ..... 98307574

(51) Int. Cl.[7] ..... G10L 19/00

(52) U.S. Cl. ..... 704/227; 704/208; 704/220

(58) Field of Search ..... 704/200, 203, 704/201, 205, 206, 207, 208, 209, 210, 220, 221, 227

(56) References Cited

U.S. PATENT DOCUMENTS

| | | | | | |
|---|---|---|---|---|---|
| 4,815,135 | A | * | 3/1989 | Taguchi | 704/217 |
| 4,885,790 | A | * | 12/1989 | McAulay et al. | 704/261 |
| 5,023,910 | A | * | 6/1991 | Thomson | 704/206 |
| 5,452,398 | A | * | 9/1995 | Yamada et al. | 704/203 |
| 6,098,036 | A | * | 8/2000 | Zinser et al. | 704/206 |

FOREIGN PATENT DOCUMENTS

| | | |
|---|---|---|
| EP | 0 666 557 | 8/1995 |
| EP | 0 865 029 | 9/1998 |
| WO | 98/05029 | 2/1998 |

OTHER PUBLICATIONS

I.S. Burnett and D.H. Pham, 'Multi–Prototype Waveform Coding Using Frame–by–Frame Analysis–by–Synthesis', ICASSP '97, vol. 2, p. 1567, Apr. 1997, Munich.

Y. Tanaka and H. Kimura, 'Low–Bit–Rate Speech Coding Using a Two–Diminsional Transform of Residual Signals and Waveform Interpolation', in Proc. IEEE Int. Conf. on Acoust., Speech and Signal Process., pp. 1–173–176, Adelaide, Australia, Apr. 1994.

Burnett, I S and Bradley, G J, "New Techniques for Multi–Prototype Waveform Coding at 2.84 kb/s", in Proc. IEEE Int. Conf. on Acoust., Speech and Signal Process, Detroit, pp. 261–264, 1995.

Michele Festa et al., 'A Speech Coding Algorithm Based on Prototypes Interpolation With Critical Bands and Phase Coding', Eurospeech '95, pp. 229–231, Madrid, Sep. 1995.

W. Bastiaan Kleijin et al., 'A General Waveform–Interpolation Structure for Speech Coding', Signal Processing Theories and Applications, M. Hoit, C. Cowan. P. Grant, W. Sandham (Eds.), p. 1665–1668, 1994.

D.W. Griffin et al., 'Multiband Excitation Vocoder', IEEE Trans. on Acoustics, Speech, and Signal Processing, vol. 36, No. 8, Aug. 1988.

Thomas F. Quatieri et al., 'Phase Coherence in Speech Reconstruction for Enhancement and Coding Applications', Proc. IEEE Int. Conf. Acoustics, Speech, and Signal Processing, Glasgow, Scotland, May 1989.

(List continued on next page.)

*Primary Examiner*—David D. Knepper
*Assistant Examiner*—Abul K. Azad
(74) *Attorney, Agent, or Firm*—Nixon & Vanderhye P.C.

(57) ABSTRACT

A speech coder is operable to compress digital data representing speech using a Waveform Interpolation speech coding method. The coding method is carried out on the residual signal from a Linear Predicative Coding stage. On the basis of a series of overlapping frames of the residual signal, a series of respective spectra are found. The evolution of the spectra is filtered in a multi-stage filtering process, the filtered phase data being replaced with the original phase data at the end of each stage. This is found to result in the decoder being better able to approximate the original speech signal. This is of particular utility in relation to mobile telephony.

11 Claims, 7 Drawing Sheets

OTHER PUBLICATIONS

Thyssen J., Kleijin B., Hagen R., 'Using a Perception–Based Frequency Scale In Waveform Interpolation', ICASSP '97, vol. 2, p. 1595, 4/1997, Munich.

Shoham Y, 'Very Low Complexity Interpolative Speech Coding at 1.2 to 2.4 KBPS', ICASSP'97, vol. 2, pp. 1599, Apr. 1997, Munich.

W. Bastiaan Kleijin et al., 'A Low–complexity Waveform Interpolation Coder', Proc. ICASSP '96 pp. 212–215.

W. Bastiaan Kleijin, 'Encoding Speech Using Prototype Waveforms', IEEE Trans. on Speech and Audio Processing, vol. 1, No. 4, Oct. 1993.

D Marston, F Plante, PWI Speech Coder in the Speech Domain, IEEE Workshop on Speech Coding for Telecommunications, 1997.

Description of AT & T 4 kbit/s coder, Delayed Contribution D. 842 (WP 2/15) to meeting of ITU Study Group 15, May/Jun. 1996, Geneva.

"Use of the pitch synchronous wavelet transform as a new decomposition method for WI", Chong et al, Proc. of 1998 IEEE International Conf. on Acoustics, Speech & Signal Processing, vol. 1, May 12–15, May 1998, pp. 513–516.

"A speech coder based on decomposition of characteristic waveforms", Proc. of the International Conf. on Acoustics, Speech & Signal Processing, vol. 1, 5/1995, pp. 508–511.

* cited by examiner

AUDIO SIGNAL PROCESSING

BACKGROUND OF THE INVENTION

1. Field of the Invention

The present invention relates to audio signal processing. It has particular utility in relation to the separation of voiced speech and unvoiced speech in low bit-rate speech coders.

2. Related Art

Low bit-rate speech coders are becoming increasingly commercially important as they enable a more efficient utilisation of the portion of the radio spectrum available to mobile phones.

Speech can be classified into three parts—voiced speech, unvoiced speech and silence. Any one of these may be corrupted by the addition of background noise. On a timescale of milliseconds, voiced speech can be viewed as a succession of repeated waveforms. This fact is exploited in a class of speech coding methods known as Prototype Waveform Interpolation (PWI) Methods. Essentially, these methods involve sending information describing repeated pitch period waveforms only once, thereby reducing the amount of bits required to encode the speech signal. Initial PWI speech coding methods only encoded voiced speech, the other portions of the speech signal were coded using other methods (e.g. Code Excited Linear Prediction methods). One example of such a hybrid coding technique is described in "Encoding Speech Using Prototype Waveforms", W. B. Kleijn, IEEE Transaction on Speech and Audio Processing Vol. 1, pp. 386–399, October 1993.

Later PWI methods were generalised so as to enable unvoiced speech and noise to be encoded as well. An example of such a method is described in "A General Waveform-Interpolation Structure for Speech Coding", W. B. Kleijn and J. Haagen, Signal Processing Theories and Applications, M. Hoit, C. Cowan, P. Grant, W. Sandham (Eds.), p1665–1668, 1994.

However, such coders have drawbacks in that the reconstituted speech sounds buzzy. The present inventors have established that the cause of this 'buzziness' is a poor separation of the voiced components of speech and the unvoiced/noisy components of speech.

BRIEF SUMMARY OF THE INVENTION

According to a first aspect of the present invention there is provided a method of extracting one of a concordant component and a discordant component of a predetermined segment of an audio signal, said method comprising the steps of:

forming an initial evolution surface from a series of combined magnitude and phase spectra representing segments of said signal around said predetermined segment;

modifying said initial evolution surface to obtain a modified evolution surface representing said one of the concordant component or the discordant component of said signal; and extracting said one of the concordant component or the discordant component of said predetermined segment from said modified evolution surface;

wherein said modifying step involves:

a plurality of component filtering steps and, prior to at least one of those filtering steps, the substitution of phase information derived from said initial evolution surface or an earlier one of the component steps for the phase information derived from the most recent component step.

Here, concordant is intended to refer to signals whose phase changes slowly in comparison to discordant signals whose phase changes more rapidly.

The present inventors have found that the rate of evolution of the phase information is useful in distinguishing between voiced speech (the concordant component of speech) and unvoiced speech/noise (the discordant component of speech).

However, it is likely that the invention will find application in other areas of audio signal processing such as the enhancement of noise-corrupted speech or music signals.

Conventional low-pass and high-pass Finite Impulse Response (FIR) digital filtering techniques do not reduce the magnitude of discordant and concordant signals respectively to zero. Therefore, they are limited in how well they can extract one of the concordant or discordant components of an audio signal.

A conventional FIR filter might be approximated by a series of shorter FIR filters. By decomposing a filtering process into a plurality of filtering stages and, in one or more of the intervals between those filtering stages, substituting phase information from an earlier stage for phase information from the most recent stage, a filtering process results which repeatedly uses the earlier phase information. Filtering a signal tends to smooth its phase and hence a filtered signal contains less information distinguishing its concordant and discordant parts. By reinstating the earlier phase information, the concordant or discordant component can be more thoroughly removed in the subsequent filtering stage (s). The result is a audio signal filtering process which is better able to extract a concordant or discordant component of an audio signal.

As suggested above, a repeated application of a low-pass filter will leave a modified evolution surface representing the concordant component of said predetermined segment. Preferably, each low-pass filtering step involves the application of an identical low-pass filter. This minimises the. complexity of the processing method.

In preferred embodiments, the phase information derived from the initial evolution surface is used in all of said component steps. This maximises the effectiveness of the extraction method.

One way in which the discordant component can be calculated is to calculate the concordant component according to the first aspect of the present invention and subtract this from the original signal. Similarly, one way in which the concordant component can be calculated is to calculate the discordant component according to the first aspect of the present invention and subtract this from the original signal.

According to a second aspect of the present invention, there is provided an audio signal processor operable to extract one of a concordant component and a discordant component of a predetermined segment of an audio signal, said apparatus comprising:

means arranged in operation to form an initial evolution surface from a series of combined magnitude and phase spectra representing segments of said signal around said predetermined segment;

means arranged in operation to modify said initial evolution surface to obtain a modified evolution surface representing said one of the concordant component or the discordant component of said signal; and means arranged in operation to extract said one of the concordant component or the discordant component of said predetermined segment from said modified evolution surface;

wherein said apparatus further comprises:

means arranged in operation to carry out a plurality of filtering steps and, prior to at least one of those filtering steps, to substitute phase information derived from said initial evolution surface or an earlier one of the component steps for the phase information derived from the most recent component step.

According to a third aspect of the present invention, there is provided a speech coding apparatus including:

a storage medium having recorded therein processor readable code processable to encode input speech data, said code including:

initial evolution surface generation code processable to generate initial evolution surface data comprising combined magnitude and phase data for segments of said input speech data;

separation code processable to derive separate phase data and magnitude data from said input speech data;

evolution surface modification code processable to generate a modified evolution surface representing one of a voiced component or an unvoiced/noise component of said input speech data; and component extraction code processable to extract said one of the voiced component or the unvoiced/noise component from said input speech data;

wherein said evolution surface modification code comprises:

evolution surface filtering code processable to filter said initial evolution surface data a plurality of times;

evolution surface decomposition code processable to derive magnitude data and phase data subsequent to one or more of said filtering steps; and earlier phase reinstatement code processable to replace the phase data obtained on processing said evolution surface decomposition code with an earlier version of the phase data.

According to another aspect of the present invention there is provided a method of waveform interpolation speech coding comprising:

forming an initial evolution surface from a series of combined characteristic waveforms or spectra representing respective segments of said speech;

wherein said formation involves aligning each of said characteristic waveforms or spectra with an earlier characteristic waveform or spectrum of said series; and said earlier waveform or spectrum is separated from the characteristic waveform or spectrum to be aligned with it by a variable number of members of said series, said variable number varying in accordance with the pitch of said signal.

It is found that the decoded version of unvoiced speech which has passed through a known waveform interpolation coder tends to have too high a periodic component. To reduce the undesirable periodic component in the output version of unvoiced speech, alignment is made with a characteristic waveform or spectrum that is far enough back in the series to have a relatively low number of overlapping samples.

BRIEF DESCRIPTION OF THE DRAWINGS

There now follows, by way of example only, a description of some embodiments of the present invention. The embodiments are described with reference to the accompanying drawings, in which.

DETAILED DESCRIPTION OF EXEMPLARY EMBODIMENTS

Figure 1:
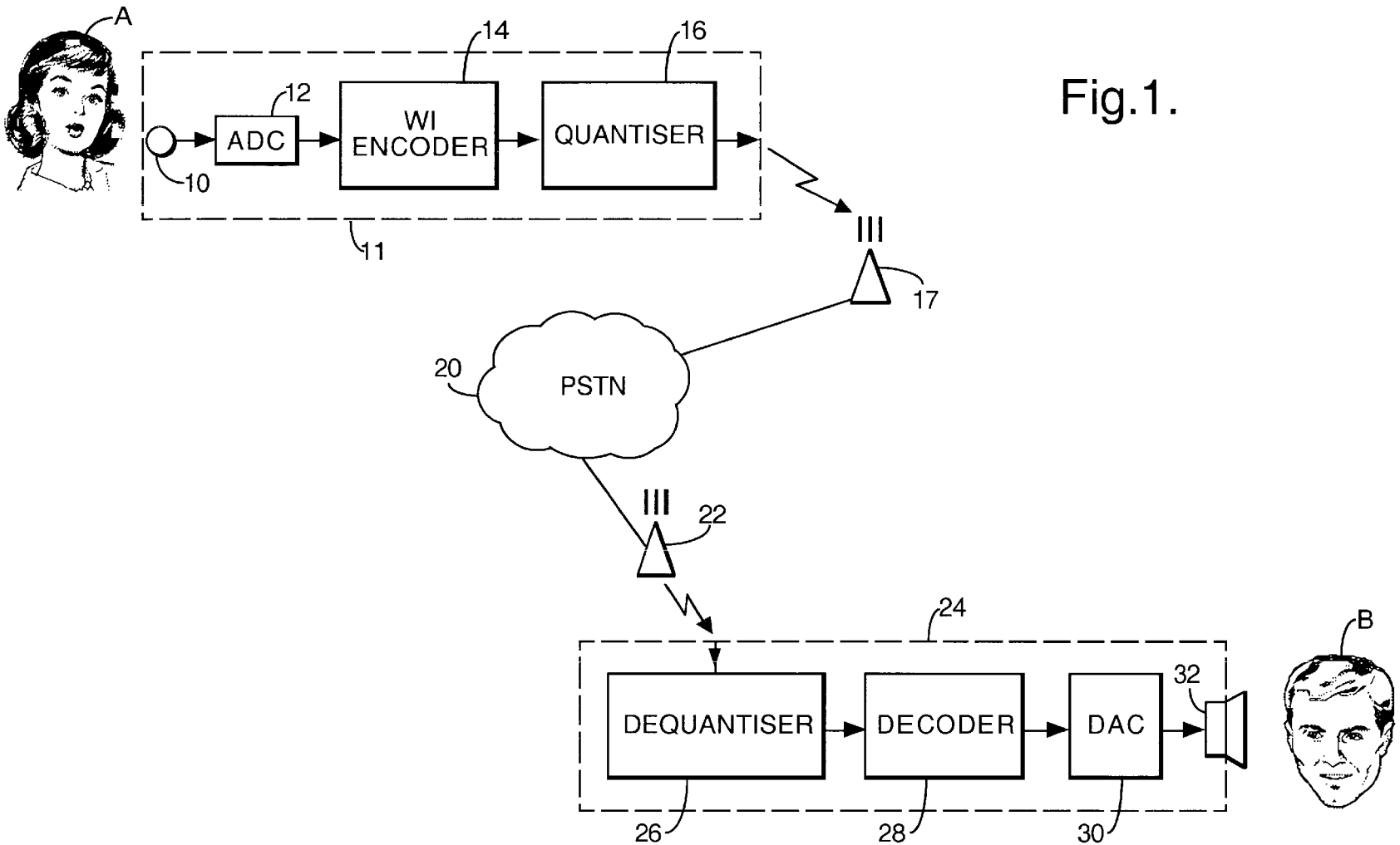
FIG. 1 is a schematic illustration of the application of a first embodiment of the present invention to a mobile telephony network.

A mobile telephone network (FIG. 1) operating in accordance with a first embodiment of the present invention is operable to allow a first user A to converse with a second user B. User A's mobile phone is operable to transmit a radio signal representing parameters modelling user A's speech. The radio signal is received by a base station 17 which converts it to a digital electrical signal which it forwards to the Public Switched Telephone Network (PSTN) 20. The Public Switched Telephone Network 20 is operated to make a connection between base station 17 and a base station 22 currently serving user B. The digital electrical signal is passed across the connection, and, on receiving the signal, the base station 22 converts the digital electrical signal to parameters representing user A's speech. Thereafter, the base station 22 transmits a radio signal representing those parameters to user B's mobile phone 24. User B's mobile phone receives the radio signal and converts it back to an analogue electrical signal which is used to drive a loudspeaker 32 to reproduce A's voice. A similar communications path exists in the other direction from user B to user A.

For each of the radio communication sections, the mobile phone network selects an appropriate bit-rate for the parameters representing the user's speech from a full bit-rate (6.7 $kbits^{-1}$), an intermediate bit-rate (4.6 $kbits^{-1}$) and a half bit-rate (2.3 $kbits^{-1}$).

The signal processing carried out in each mobile phone is now described in more detail. User A speaks into the microphone 10 of his mobile telephone 11 which converts his voice into an analogue electrical signal. This analogue signal is then passed to an Analogue to Digital Converter (ADC) 12 which digitises the signal to provide a 64 $kbits^{-1}$ digitally coded speech signal. A Waveform Interpolation (WI) encoder 14 receives the digitally coded speech signal and reduces it to a 6.7 $kbits^{-1}$ stream of parameters which represent user A's speech. The parameters are passed to a quantiser 16 which is operable to provide a variable rate parameter stream. The quantiser may simply forward the full-rate parameter stream or, if required, reduce the bit-rate of the parameter stream still further to the intermediate rate (4.6 $kbits^{-1}$) or the half-rate (2.3 $kbits^{-1}$).

It will be realised by those skilled in the art that the variable rate parameter stream undergoes further channel coding before being converted to a radio signal for transmission over the radio communication path to the base station 17.

User B's mobile phone recovers the variable rate parameter stream and, if required, uses interpolation to generate the 6.7 $kbits^{-1}$ parameter stream before passing the parameters to a decoder 28. The decoder 28 processes the parameter stream to provide a digitally coded reconstruction of user A's speech which is then converted to an analogue electrical signal by the Digital to Analogue Converter (DAC) 30, which signal is used to drive the loudspeaker 32.

The operation of the WI encoder 14 will now be described in more detail. The encoder 14 of user A's mobile phone receives the digitally coded speech signal from the Analogue to Digital Converter 30 and carries out a number of processes (FIG. 2) on the digitally coded speech signal to provide the stream of parameters representing user A's speech.

The encoder first divides the digitally coded speech signal into 10 ms frames. Linear Predictive Coding (LPC) techniques (34,36,38) are then used in a conventional manner to provide, for each frame, a set of ten spectral shape parameters (Line Spectral Frequencies or LSFs) and a residual signal.

A pitch period detection process 40 provides a measure (expressed as a number of sample instants) of the pitch of the current frame of speech.

The residual signal then passes to a waveform extraction process which is carried out to obtain a characteristic waveform for each one of four 2.5 ms sub-frames of each frame. Each characteristic waveform has a length equal to the pitch period of the signal at that sub-frame. Given that voiced speech normally has a pitch period in the range 2 ms to 18.75 ms, it will be realised that the characteristic waveforms will normally overlap one another to a significant degree. The residual signal for voiced speech has a sharp spike in each pitch period and the window used to isolate the pitch period concerned is movable by a few sample points so as to ensure the spike is not close to the edge of the window. Expressed in mathematical notation, the characteristic waveforms are obtained by windowing the residual signal as follows:

$$cw[i,k] = res\left(k + 20i - \frac{p_i}{2} - 1 - q\right) \quad \text{where} \qquad \text{Equation 1}$$

$$i = 0, 1, 2, 3 \quad \text{and} \quad k = 1, 2, 3 \ldots p_i$$

Where cw[i,k] represents the characteristic waveform for the ith sub-frame and res(x) means the value of the xth sample of the residual signal. The pitch period from the pitch detector is $p_i$ and, if required, q is increased from 0 to 4 in order to shift the spike in the residual away from the edge of the window.

The characteristic waveforms (of length $p_i$) thus extracted then undergo a Discrete Fourier Transform (DFT) 44 to produce, for each residual sub-frame, a characteristic spectrum. In mathematical notation, the characteristic spectra (CS) are calculated as follows:

$$CS[i,\omega]=DFT(cw[i,k],p_i) \qquad \text{Equation 2}$$

Where CS[i,ω] is a complex value associated with a frequency interval ω and the ith sub-frame of the residual, the complex values for all frequency intervals forming a complex spectrum for the ith sub-frame of the residual. cw[i,k] and $p_i$ are as defined above.

The conventional technique of zero-padding is then used to expand the characteristic spectra so that they are all 76 values in length. To compensate for the effect of this on the power spectrum, the magnitude part of the characteristic spectra relating to shorter pitch periods is decreased in proportion to the pitch period associated with the residual sub-frame from which it is derived. In mathematical notation:

$$|CS_{norm}[i,\omega]| = \frac{150}{p_i}|CS[i,\omega]| \quad \text{where} \qquad \text{Equation 3}$$

$$\omega = 0, 1, 2, \ldots, 76$$

Where $|CS_{norm}[i,\omega]|$ represents the magnitude (or, in mathematical language, modulus) of the normalised complex spectral values and |CS[i,ω]| represents the magnitude of the complex value CS[i,ω]–$p_i$ is as defined above.

It will be realised that the characteristic spectra are generally obtained from signal segments which overlap at least the signal segments used in deriving the previous and subsequent characteristic spectra. For voiced speech segments, there will be little difference in the magnitude of the complex values associated with each frequency interval of a spectrum and the corresponding magnitude values of the spectra derived from adjacent segments of the signal. However, the time offset between the adjacent signals manifests itself as a phase offset between adjacent spectra. In order to correct this phase offset the phase spectra (consisting of the phase, or, in mathematical language, argument of the complex spectral values) are operated on by alignment process 46.

Where the pitch period of the signal is long, a large number of samples may be used in calculating both a current spectrum and the spectra on either side. This leads to a similarity between adjacent spectra even in signals that are noisy in character. This similarity is undesirable since it reduces the distinction between voiced and unvoiced speech. In order to prevent such similarity arising in relation to unvoiced speech/noise each characteristic spectrum is aligned with another characteristic spectrum which may precede it by a many as four sub-frames. The interval (measured in sub-frames) between the characteristic spectra which are aligned with one another increases with increasing pitch period as follows:

if $p_4<90$ then d=1
if $90 \leqq p_4<105$ then d=2
if $105 \leqq p_4<125$ then d=3
if $p_4 \leqq 125$ then d=4

The alignment process shifts the phase values of one of the characteristic spectra to be aligned until the correlation between phase values of the two spectra reaches a maximum. The offset that is required to do this provides a phase correction for each one of the 76 frequency bins in the characteristic spectrum associated with a given sub-frame. The 'aligned' phase values are calculated by summing the original phase values and the phase correction (each is expressed in radians).

The phase spectrum is then combined with the magnitude spectrum associated with the sub-frame to provide an aligned characteristic spectrum for each sub-frame. Expressed mathematically, $$CS_{aligned}[i,\omega]=|CS_{norm}[i,\omega]|e^{j\angle CS_{aligned}[i,\omega]} \qquad \text{Equation 4}$$

Where j is $\sqrt{-1}$, and $\angle CS_{aligned}[i,\omega]$ represents the phase value obtained for the frequency interval o associated with the ith sub-frame following the alignment procedure.

A normal representation of a spectrum has a series of bars spaced along a frequency axis and representing consecutive frequency intervals. The height of each bar is proportional to magnitude of the complex spectral value associated with the corresponding frequency interval. It is possible to visualise a further axis arranged perpendicularly to the frequency axis which represents the time at which a spectrum was obtained. Another spectrum derived a time interval later can then be visualised aligned with and parallel to the first spectrum and spaced therefrom in accordance with the scaling of the time axis. If this process is repeated for several spectra then a surface defined by the tops of the bars can be envisaged or computed from the individual magnitudes.

Figure 3A:
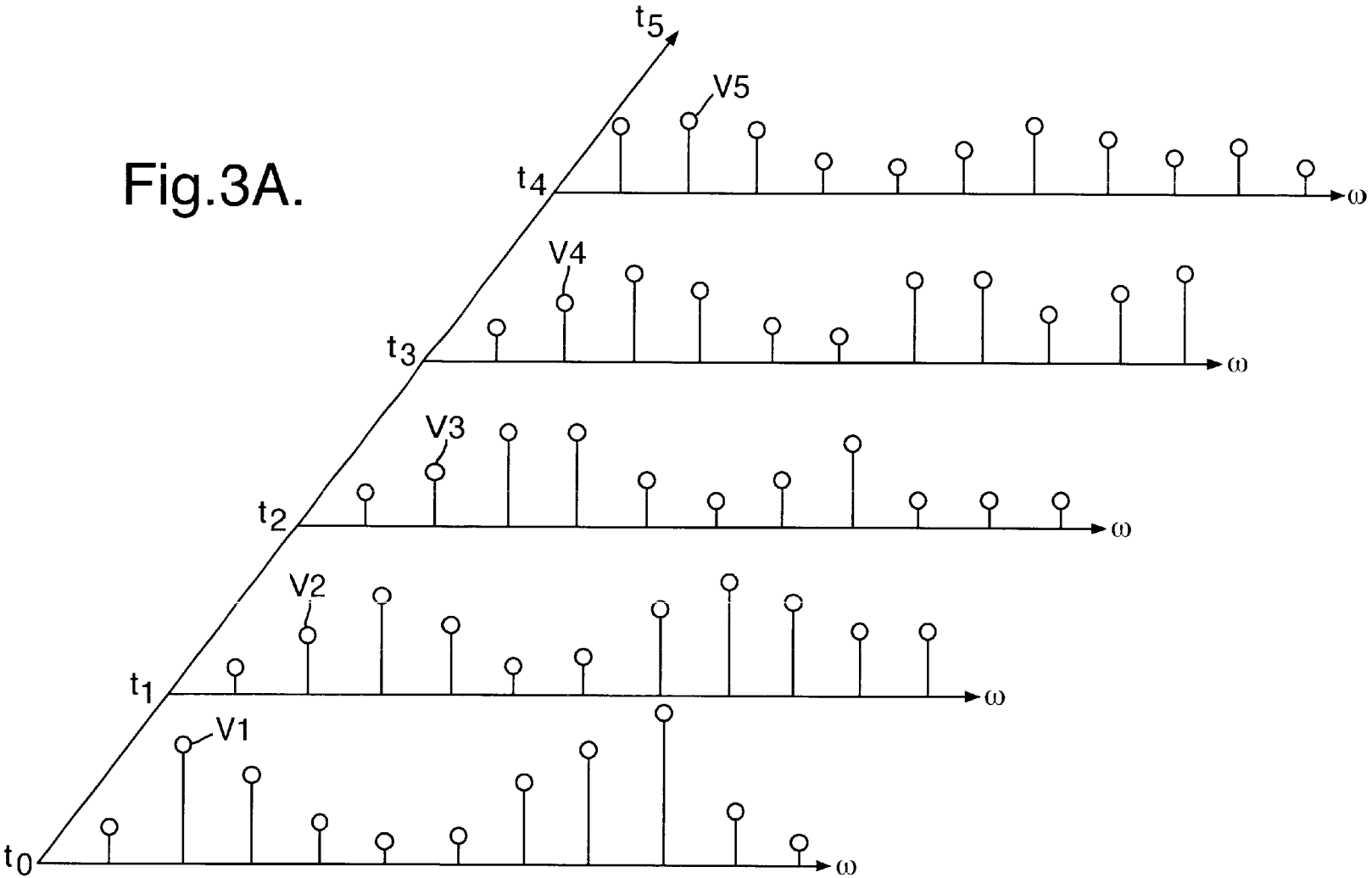
FIG. 3A is a schematic illustration of a spectral evolution surface produced during the operation of the encoder of FIG. 2.

A simplified illustration of such a visualisation of the 'aligned' characteristic spectra output by alignment stage 46 is shown in FIG. 3A (note that the alignment does not alter the magnitudes of the complex values forming the characteristic spectra and hence FIG. 3A equally well represents the normalised characteristic spectra). For ease of illustration, only 11 spectral values are shown, rather than 76 as is actually the case in the embodiment.

The so-called 'evolution' of a spectral magnitude associated with a given frequency interval can be envisaged as the variation in that spectral magnitude over spectra derived from consecutive time intervals. The evolution of the magnitude associated with the second lowest frequency interval from time $t_0$ to $t_4$ in FIG. 3A is therefore the succession of values V1,V2,V3,V4,V5.

Figure 3B:
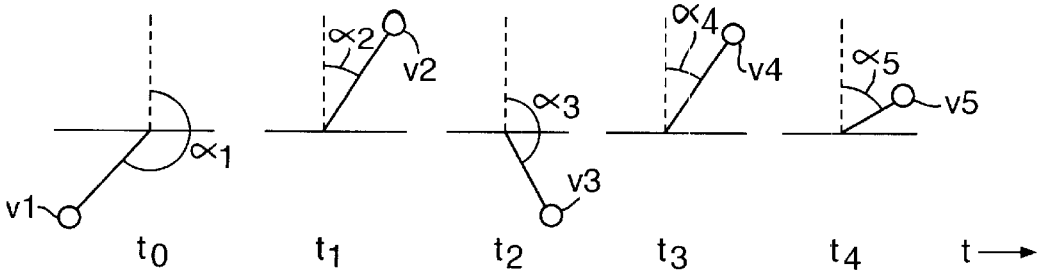
FIG. 3B shows the evolution of an unvoiced speech frequency component over time.
Figure 3C:
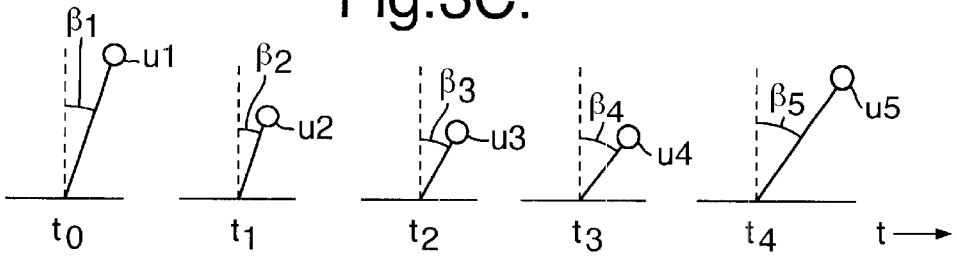
FIG. 3C shows the evolution of a voiced speech frequency component over time.

As indicated above, the complex spectra in fact contain phase values as well as the magnitudes associated with a given frequency interval. The present inventors have found that an evolution of the complex spectral values associated unvoiced speech is more erratic than an analogous evolution derived from voiced speech. In particular, the phase component of the complex value varies more erratically for unvoiced speech. FIG. 3B illustrates how a complex spectral value derived from unvoiced speech might evolve (the length of the line represents the magnitude, the angle $\alpha$ represents the phase). FIG. 3C shows an evolution likely to be associated with voiced speech.

Figure 4:
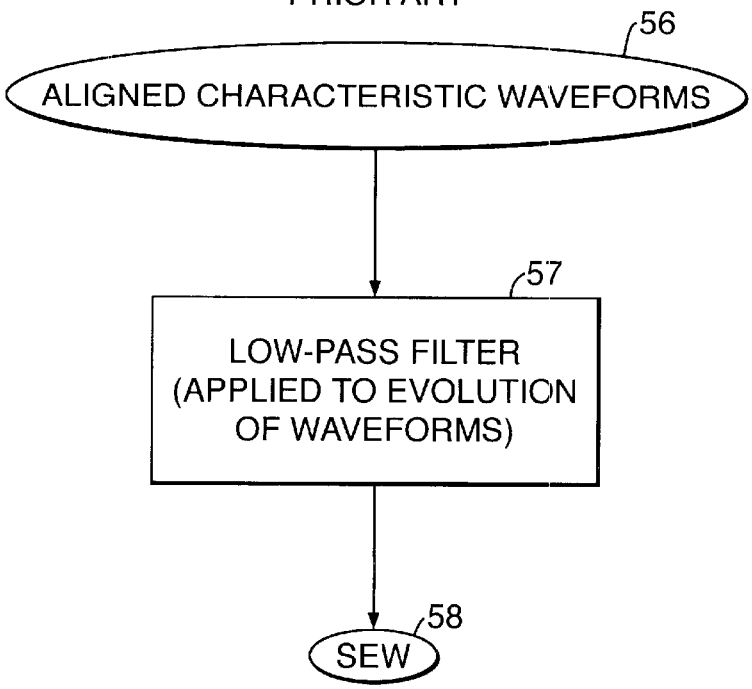
Fig.4. PRIOR ART
FIG. 4 is a flow diagram which illustrates an evolution surface derivation method of prior-art encoders.

Returning to FIG. 2, a Slowly Evolving Spectrum generation process 48 receives the aligned characteristic spectra and processes them to obtain a Slowly Evolving Spectrum. Conventionally, this has been done by storing, say, seven consecutive spectra and then applying a moving average filter to the evolution of the complex values associated with each frequency interval (FIG. 4). Expressed in mathematical notation (here the complex spectral numbers are represented in the form of Real and Imaginary parts but the conversion from the Magnitude and Phase representation is trivial)

$$SES[i,\omega] = \sum_{m=-3}^{3} a_m \Re e\{CS_{aligned}[i+m,\omega]\} + \sum_{m=-3}^{3} a_m \Im m\{CS_{aligned}[i+m,\omega]\} \qquad \text{Equation 5}$$

Where SES[i,ω] represents the complex spectral values of a modified spectrum for the ith sub-frame of the residual signal and $a_m$ represent the coefficients of the moving average filter.

Figure 5:
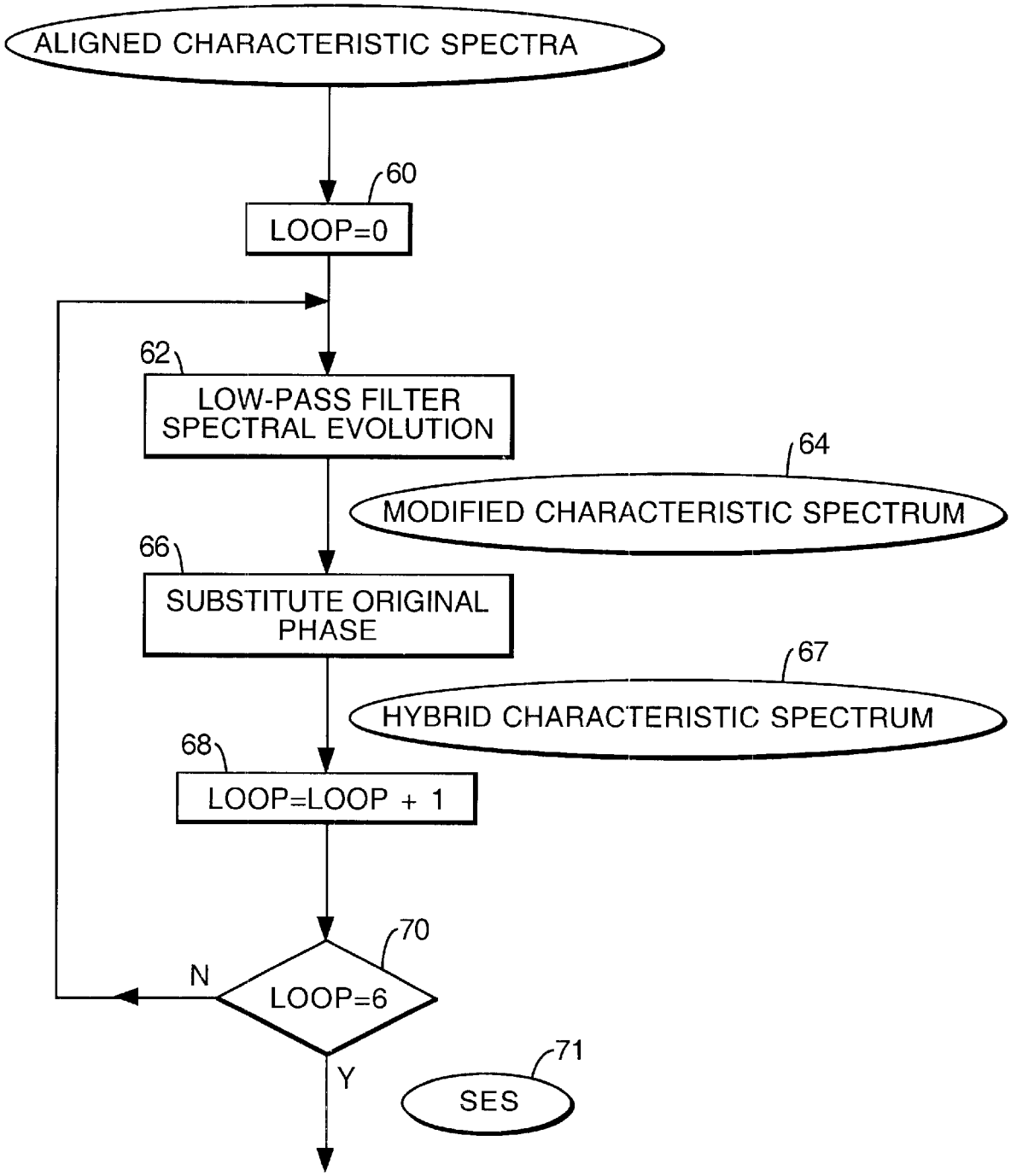
FIG. 5 is a flow diagram which illustrates the evolution surface derivation method of the first embodiment.

According to the present embodiment, for each sub-frame, a series of operations are carried out on stored aligned characteristic spectra including the one associated with the current sub-frame and the six respectively associated with the six nearest sub-frames (FIG. 5). In the first of these operations, a counter is set to zero (step 60). A moving average filter 62 is then applied to the evolutions of the complex spectral values associated with respective frequency intervals to provide a modified spectrum 64 to be associated with the current sub-frame.

The phase values of the modified spectrum are then replaced (step 66) by the phase values of the aligned characteristic spectrum associated with the current sub-frame to provide a hybrid characteristic spectrum 67 associated with the current sub-frame.

The counter is then increased by one (step 68) and a check is made on the value of the counter (step 70). If it has not yet reached six then the filtering 62 and phase replacement 66 steps are carried out on the hybrid characteristic spectrum just obtained.

If the counter has reached six then the magnitude values of the hybrid characteristic spectrum 67 obtained after the sixth replacement operation are output by the Slowly Evolving Spectrum generation process (FIG. 2, 48) as the Slowly Evolving Spectrum 71 for the current sub-frame.

The Slowly Evolving Spectrum (SES) 71 is passed to the Rapidly Evolving Spectrum generation process 50. The Rapidly Evolving Spectrum (RES) generation process 50 subtracts the SES magnitude values from the corresponding magnitude values of the aligned characteristic spectrum associated with the current sub-frame to provide the magnitude values of the RES.

Both the SES magnitude values and the RES magnitude values are then arranged into Mel-scaled frequency intervals and the SES magnitude values 52 and RES magnitude values 54 for one out of every two sub-frames are forwarded to the quantiser (FIG. 1, 16).

As explained in relation to FIG. 1, the stream of parameters (pitch 41, RES magnitude values 54, SES magnitude values 52, LSFs 37) output by the WI encoder 14 are received at the decoder 28 in user B's mobile phone 24.

Figure 6:
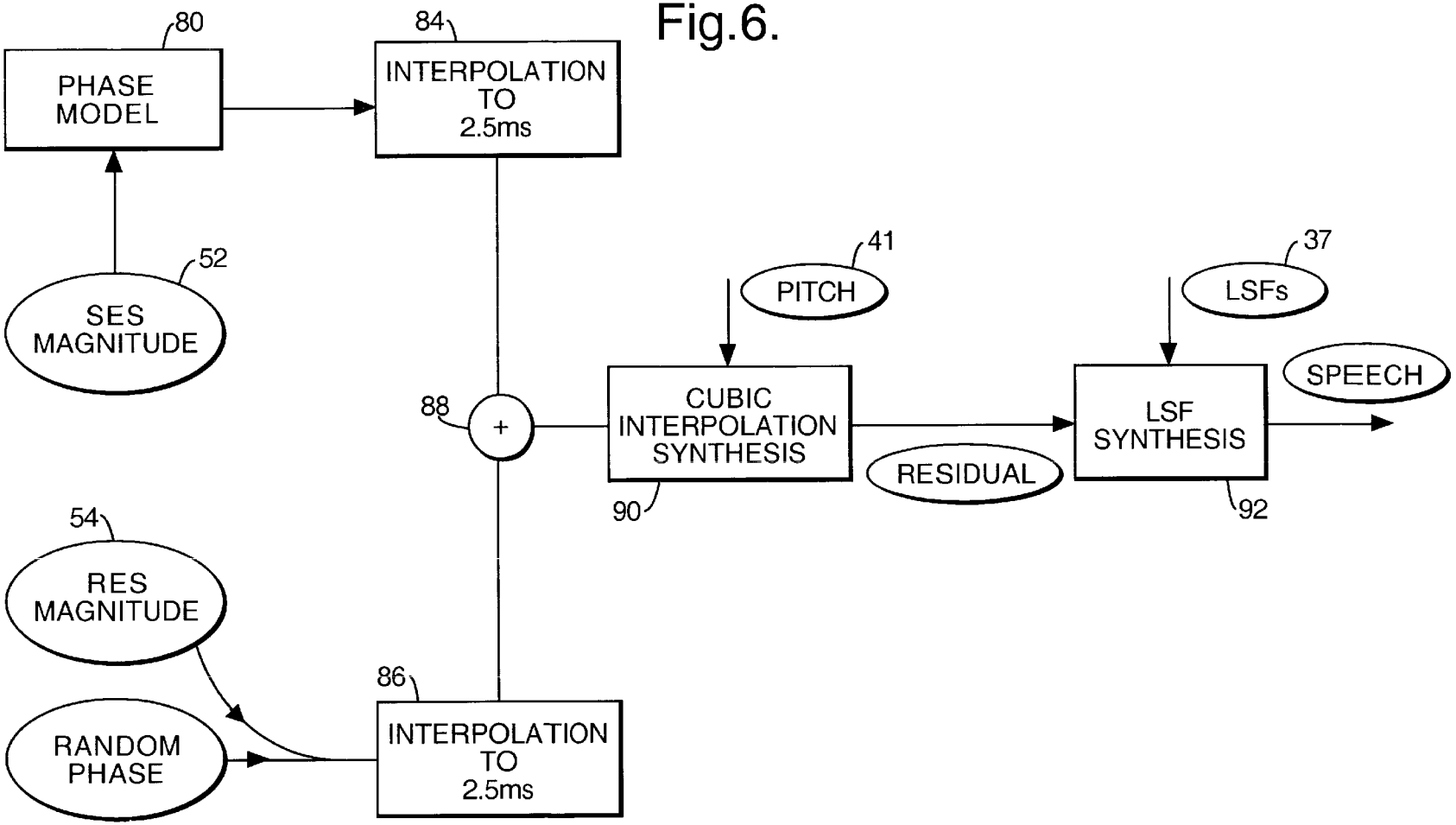
FIG. 6 shows the processes carried out by the decoder part of a mobile telephone according to the first embodiment of the present invention.

The processes carried out in the decoder 28 are now described with reference to FIG. 6. The SES magnitude values 52 are passed to a phase generation process 80 which generates phase values to be associated with the magnitude values on the basis of known assumptions. In this embodiment the phase values are generated in the way described in the Applicant's International Patent Application No. PCT/GB97/02037 published as WO 98/05029. The phase values and the SES magnitude values are combined to provide a complex SES characteristic spectrum.

The RES magnitude values 54 are combined with random phase values 82 to generate a complex RES characteristic spectrum.

Figure 2:
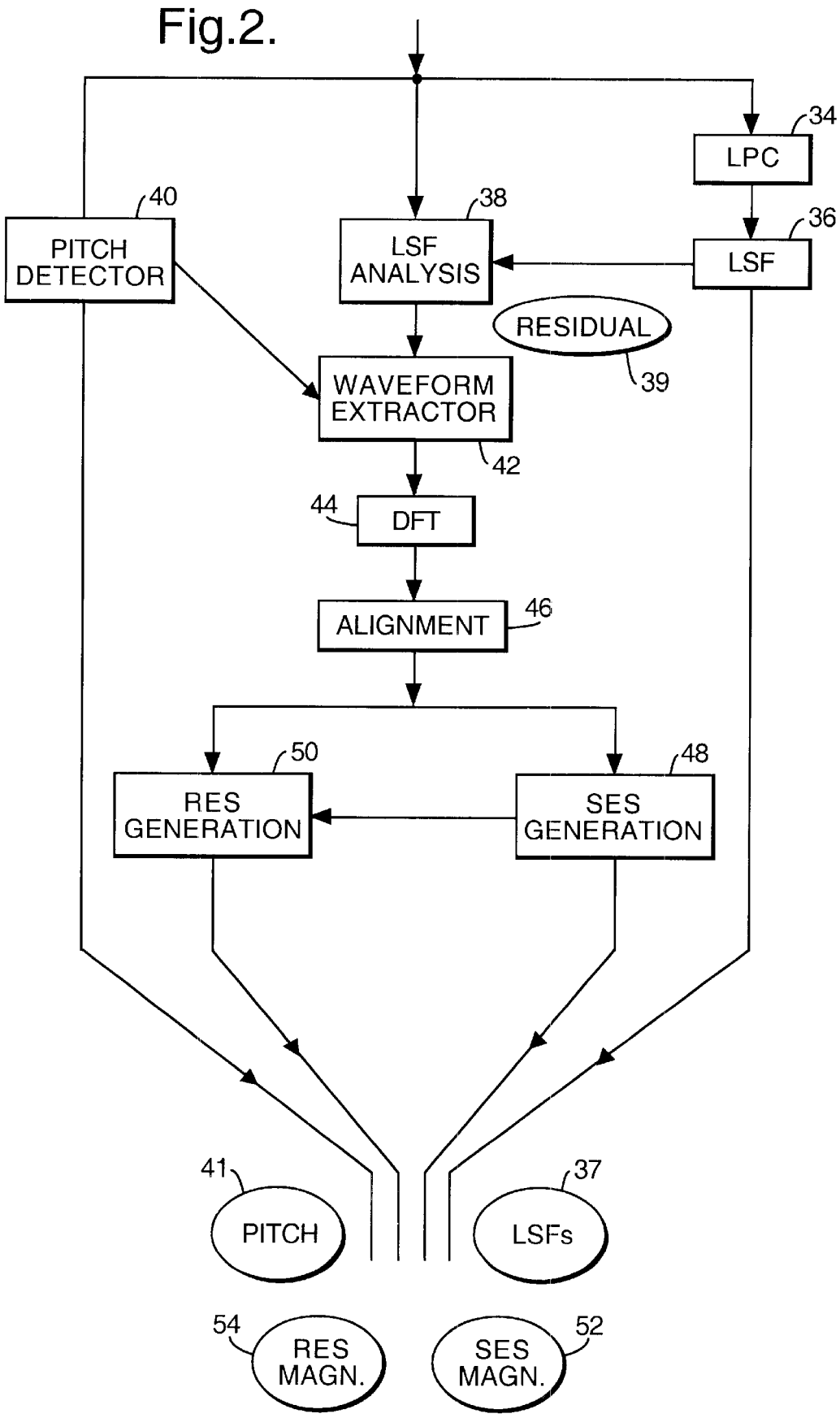
FIG. 2 shows the processes carried out in an encoder part of a mobile telephone forming part of the network of FIG. 1.

Interpolation processes 84,86 are then carried out on the two types of spectra to obtain one spectra of each type every 2.5 ms. The two spectra thus created are then combined 88 to provide an approximation to a characteristic spectrum for each sub-frame. The approximate characteristic spectrum is then passed, together with the pitch 41, to a cubic interpolation synthesis process 90 which operates in a known manner to reconstruct an approximation to the residual signal originally derived in the LSF analysis process in the encoder (FIG. 2, 38). A filter 92 which is the inverse of the analysis filter (FIG. 2, 38) is then used to provide an approximation of the audio signal originally passed to the encoder (FIG. 1, 14).

Owing to the nature of the decoding process (FIG. 6), it is important that the SES magnitude values 52 are very low for unvoiced speech. If this is not the case then unvoiced speech components are synthesised in the same way as voiced components which results in the output speech sounding buzzy.

In the above-described embodiment of the present invention, the SES generation process (FIG. 2, 48) is better able to reduce the SES magnitude values associated with unvoiced speech than the processes used in prior-art PWI encoders. In prior-art coders the erratic evolution of the phase values does result in the low-pass filtering operation (FIG. 4, 57) reducing the magnitude values of the resultant SEW for the corresponding frequency interval. However, the present invention improves on this since it gives extra weight to the phase information in the characteristic spectrum (it will be recalled that it is the phase information that especially distinguishes unvoiced speech/noise from voiced speech). Extra weighting of the phase information is achieved by replacing the phase values at each stage of the iterative filtering process and thereby reintroducing the erratic phase values that particularly distinguish voiced and unvoiced speech before the next filtering stage. The result is low SES magnitudes associated with unvoiced speech and hence a less buzzy output than known encoders.

Figure 7:
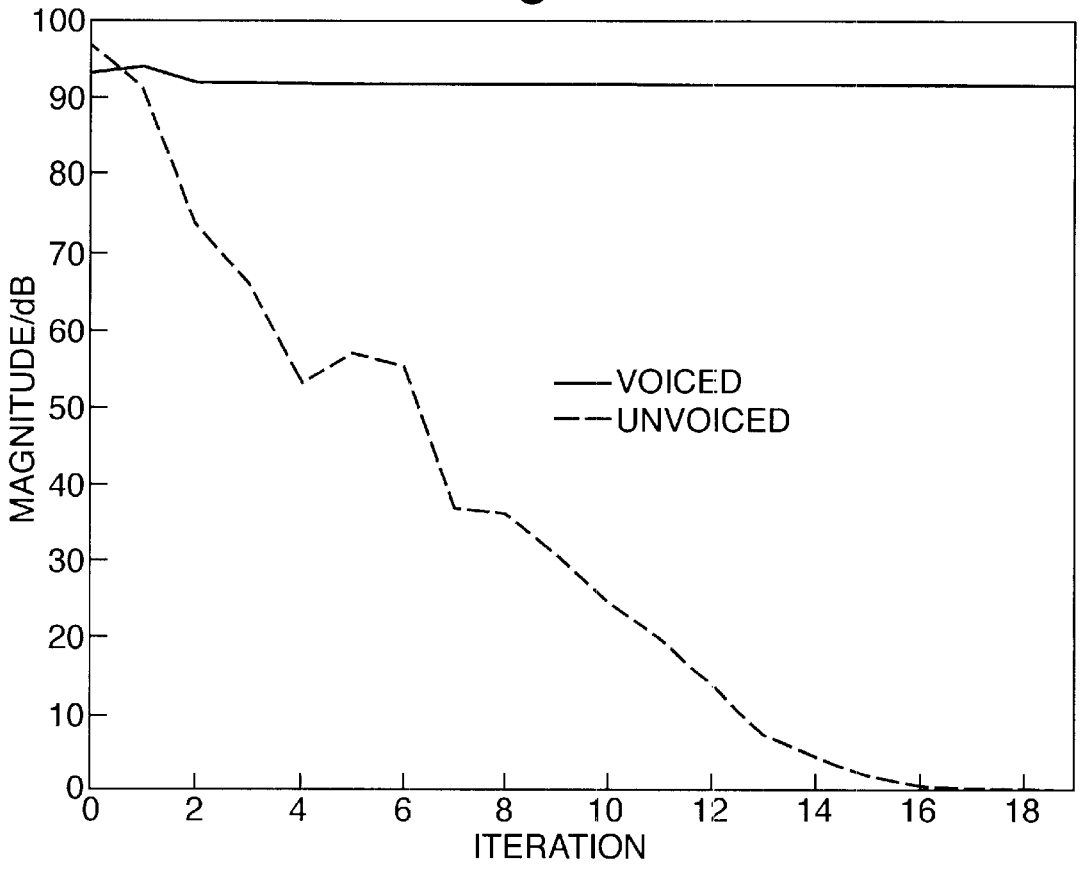
FIG. 7 illustrates the reduction of the unvoiced components of the evolution surface achieved using the method of the first embodiment.

The reduction of the SES magnitude with repeated filtering stages is illustrated in FIG. 7. It can be seen that there is little reduction in magnitude values associated with voiced speech, but that repeated iterations of the filter strongly reduce the magnitude values associated with unvoiced speech.

In other embodiments, in the SES generation process, the phase values obtained from any earlier filtering stage could be used to replace the phase resulting after a later filtering stage. Such a method would still provide a degree of improvement over the prior-art.

The above described processes (40, 42, 44, 46) which extract SES magnitude values from the residual signal could be used to derive a voicing measure for each of the frequency bands for each sub-frame. The voicing measure might simply be the ratio of the output SES magnitude to the original characteristic spectrum magnitude for a given frequency interval. Such a set of processes might be useful in a Multi-Band Excitation speech coder.

At the expense of extra processing, the alignment stage 46 might be included within the repeated processes contained within the loop illustrated in FIG. 5. This would correct any drift introduced by the filtering process.

Those skilled in the art will be able to conceive of many different low-pass filters that may be used in the low-pass filtering process 62.

In the above embodiment, each of the characteristic spectra corresponds to a single pitch period of the residual signal. Instead, the characteristic waveforms could be of a fixed length allowing the use of an efficient Fast Fourier Transform (FFT) algorithm to calculate the characteristic spectra. The characteristic spectra might then contain peaks and troughs corresponding to the fundamental of the input signal (which, of course, need not be a residual signal). The application of the iterative process described in relation to FIG. 5 would then retain the peaks but reduce the troughs further. Such a method is likely to have application in noise reduction algorithms that might be applied to speech, music or any other at least partly periodic audio signals.

The improved separation of the spectra representing the unvoiced and voiced speech might also find application in speech recognition devices.

What is claimed is:

1. A method of analyzing an audio signal includes extracting one of a concordant component and a discordant component of a predetermined segment of said audio signal, said method comprising the steps of:

forming an initial evolution surface from a series of combined magnitude and phase spectra representing segments of said signal around said predetermined segment;

modifying, as part of analyzing said audio signal, includes initial evolution surface to obtain a modified evolution surface representing said one of the concordant component or the discordant component of said signal; and extracting, as part of analyzing said audio signal, includes one of the concordant component or the discordant component of said predetermined segment from said modified evolution surface;

wherein said modifying step involves:

a plurality of component filtering steps, and prior to at lest one of those filtering steps, the substitution of phase information derived from said initial evolution surface or an earlier one of the component steps for the phase information derived from the most recent component step.

2. A method according to claim 1 wherein said component steps comprise respective low-pass filtering steps whereby said modification step provides a modified evolution surface representing the concordant component of said predetermined segment.

3. A method according to claim 2 wherein each low-pass filtering step involves the application of an identical low-pass filter.

4. A method according to claim 1 wherein phase information derived from said initial evolution surface is used in all of said component steps.

5. A method according to claim 1 further comprising the step of calculating the other of the concordant component and the discordant component by subtracting said one of the two components from said initial evolution surface.

6. A method according to claim 1 wherein said component steps comprise respective high-pass filtering steps whereby said modification step provides a modified evolution surface representing the discordant component of said predetermined segment.

7. A method according to claim 1 wherein said audio signal is substantially periodic and each predetermined segment represents a different pitch period.

8. A method of separating voiced speech from unvoiced speech and noise, said method comprising the steps of claim 1 where said audio signal represents speech and said voiced speech corresponds to said concordant component and said unvoiced speech and noise corresponds to said discordant component.

9. A method of speech coding comprising the separation method of claim 8 whereby more information is used to code the voiced speech than is used to code the unvoiced speech and noise.

10. An audio signal processor operable for analyzing an audio signal includes extracting one of a concordant component and a discordant component of a predetermined segment of said audio signal, said processor comprising:

means arranged in operation to form an initial evolution surface from a series of combined magnitude and phase spectra representing segments of said signal around said predetermined segment;

means arranged in operation to modify, as part of analyzing said audio signal, includes initial evolution surface to obtain a modified evolution surface representing said one of the concordant component or the discordant component of said signal; and means arranged in operation to extract, as part of analyzing said audio signal, includes one of the concordant component or the discordant component of said predetermined segment from said modified evolution surface;

wherein said processor in order to analyze said audio signal further comprises:

means arranged in operation to carry out a plurality of filtering steps, and prior to at lest one of those filtering steps, the substitution of phase information derived from said initial evolution surface or an earlier one of the component steps for the phase information derived from the most recent component step.

11. A speech coding apparatus including:

a storage medium having recorded therein processor readable code processable to encode input speech data, said code including:

initial evolution surface generation code processable to generate initial evolution surface data comprising combined magnitude and phase data for segments of said input speech data;

separation code processable to derive separate phase data and magnitude data from said input speech data;

evolution surface modification code processable to generate a modified evolution surface representing one of a voiced component or an unvoiced/noise component of said input speech data; and component extraction code processable to extract said one of the voiced component or the unvoiced/noise component from said input speech data; wherein said evolution surface modification code comprises:

evolution surface filtering code processable to filter said initial evolution surface data a plurality of times;

evolution surface decomposition code processable to derive magnitude data and phase data subsequent to one or more of said filtering steps; and earlier phase reinstatement code processable to replace the phase data obtained on processing said evolution surface decomposition code with an earlier version of the phase data.

* * * * *